United States Patent [19]

Cahuzac

[11] Patent Number: 4,492,096

[45] Date of Patent: Jan. 8, 1985

[54] HOLLOW REINFORCEMENTS OF REVOLUTION MADE BY THREE-DIMENSIONAL WEAVING METHOD AND MACHINE FOR FABRICATING SUCH REINFORCEMENTS

[75] Inventor: Georges J. J. Cahuzac, Le Bouscat, France

[73] Assignee: Societe Nationale Industrielle Aerospatiale, France

[21] Appl. No.: 508,186

[22] Filed: Jun. 27, 1983

[30] Foreign Application Priority Data

Jul. 2, 1982 [FR] France ..... 82 11693

[51] Int. Cl.[3] ..... D04B 9/12; D04B 9/14; D04B 9/16; D04B 9/44

[52] U.S. Cl. ..... 66/11; 66/10; 66/13; 139/14; 156/148

[58] Field of Search ..... 66/125 R, 125 A, 10 B, 66/11, 13, 169 R, 190; 139/11, 20, 14, DIG. 1, 22; 156/148

[56] References Cited

U.S. PATENT DOCUMENTS

| | | | |
|---|---|---|---|
| 3,904,464 | 9/1975 | King | 156/148 |
| 3,993,817 | 11/1976 | Schultz | 156/148 |
| 4,013,103 | 3/1977 | Kulczychi et al. | 139/DIG. 1 |
| 4,038,440 | 7/1977 | King | 156/148 |
| 4,080,807 | 3/1978 | Maisel | 66/13 |
| 4,183,232 | 1/1980 | Banos et al. | 139/14 |
| 4,393,669 | 7/1983 | Cahuzac | 66/13 |

FOREIGN PATENT DOCUMENTS

| | | | |
|---|---|---|---|
| 15824 | 11/1934 | Australia | 156/148 |

*Primary Examiner*—Ronald Feldbaum
*Assistant Examiner*—Mary A. Ellis
*Attorney, Agent, or Firm*—McGlew and Tuttle

[57] ABSTRACT

The invention concerns the production of deformable hollow reinforcements of revolution by a three-dimensional weaving. In a network of rods 18 held and rotated about a vertical axis 11 by rotary perforated plates 52, 53, 54, there are inserted in oblique crossed directions, i.e. non-radial directions, threads in the form of chain stitch loops produced by a knitting device 32. The chain stitches are downwardly compacted by the lower edge of the plate 52 which is inclined for this purpose.

20 Claims, 9 Drawing Figures

HOLLOW REINFORCEMENTS OF REVOLUTION MADE BY THREE-DIMENSIONAL WEAVING METHOD AND MACHINE FOR FABRICATING SUCH REINFORCEMENTS

FIELD AND BACKGROUND OF THE INVENTION

The present invention relates to the fabrication of hollow parts of revolution by three-dimensional weaving.

Woven parts of this type act as reinforcements in the fabrication of cylindrical, conical or cylindro-conical hollow bodies obtained by impregnation with a suitable binder followed by machining to the desired precise dimensions of the hollow bodies. Such hollow bodies are employed in particular in the aeronautical field for ballistic objects or rockets such as nozzles, thermal screens or propeller bases. More generally, this type of part can be used in industry whenever high standards are required as concerns mechanical stresses, thermal insulation or high impact and ablation resistance.

Various methods are known for producing hollow cylinders or hollow parts of revolution.

U.S. Pat. No. 3,904,464 discloses a method for producing a hollow body of revolution. It comprises forming, on a specialized tool having the inner shape of the part, a porcupine of radial picots of fibres and polymerized resin. Threads pre-impregnated with resin are wound inside the picots which define passages. A polymerization and then a machining are then carried out. In order to improve the mechanical and thermal properties of the material, the operation may be repeated. This method has drawbacks: the reinforcement is long and complicated to make up and the fabricating operations are numerous and not applicable to all types of fibers.

French Pat. No. 73/14 956 (in the name of the applicant) discloses equipment for producing hollow parts of revolution by a three-dimensional weaving. By means of a perforated head, circumferential and radial threads are simultaneously disposed through a network of longitudinal rods of fibres and polymerized resin. This method permits the production of cylindrical parts, or conical parts with some difficulties, but does not permit the production of parts of complex shapes.

The two embodiments just mentioned have another drawback concerning the quality of the parts obtained, which depends on the fibre content of the latter. This quality depends on an even compacting in the course of fabrication. This compacting is mostly manual and is not effected after the depositing of each layer. The part obtained is heterogeneous if it is thick and this affects its mechanical and thermal properties.

Improvements appear in U.S. Pat. No. 4,183,232 also owned by the applicant. Hollow parts of cylindrical, conical or cylindro-conical shape are produced by introducing between vertically maintained metal rods a helical layer of circumferential and radial threads throughout the height of the part. This method is characterized by the deposit of circumferential threads under low tension and by a radial chain stitching weaving. Throughout the weaving operation, the layers are constantly compacted. The rods are then eliminated and are replaced by threads according to an automatic lacing method described by the applicant in U.S. Pat. No. 4,393,669.

This method permits the production of parts of cylindrical or complex shapes having good mechanical and thermal properties. However, the tooling employed remains relatively complicated and the final shape of the parts is fixed by the weaving operation. An adaptation of the fabricating equipment is required for each type of shape to be obtained.

SUMMARY OF THE INVENTION

An object of the invention is to produce, by a three-dimensional weaving hollow cylinders which are deformable owing to a special structure and provide, by a simple deformation, parts which have such and such desired complex shape.

The invention therefore provides first of all a part or reinforcement in the shape of a cylindrical body which is hollow and of revolution produced in the known manner by a three-dimensional weaving of three thread systems which cross substantially in the directions of a trirectangular trihedral, namely a first system of threads parallel to the axis of the reinforcement and disposed to be equidistant in coaxial sheets which are themselves equidistant, and a second system and a third system of threads substantially contained in planes perpendicular to said axis, forming layers which are superimposed and inserted in two respective series of crossed passages defined by the threads of the first system. According to the invention, the threads of the first system are in staggered relation from one sheet to the following sheet and the two series of crossed passages defined therebetween extend through the thickness of the reinforcement obliquely i.e. non-radially. This arrangement results in a deformable structure principally owing to the absence of circumferential threads and radial threads, which are replaced by oblique threads which do not oppose deformations which tend to vary the local diameter of the woven hollow part (with a corresponding variation in the thickness of its wall). Preferably, the passages of the two aforementioned series have an obliqueness of the same value, but of opposite direction, relative to the radial directions at their intersections. In other words, any two passages which cross are symmetrical relative to the radial plane passing through their intersection. The corresponding threads therefore form squares which have one diagonal which is radial and which are easily deformed into a diamond shape.

In a preferred embodiment, the threads of the second and third systems are formed by the loops of two respective chain stitches made in the form of helical coils in the thread network of the first system.

Outside the machine, the threads of the second and third systems make sure that due to their loops, the obtained product will keep its thickness and, due to their frictional adhesion to the threads of the first system, the structure as a whole will hold firmly together. For example, prior to being impregnated, the obtained product might be cut to slices without affecting the cohesion of the woven structure. For the same reason of frictional cohesion of the threads, the product may be subject to deformation, to give it the desired shape. The term "structure" within the context of this specification applies to the particular arrangement of the constituent threads.

The invention also provides a method of producing such woven reinforcements having a triple system of component threads, comprising, in the known manner, forming around an axis an arranged network of filiform elements parallel to said axis and embodying the threads of the first system and evenly disposed in successive coaxial sheets, and introducing in the two series of crossed passages created by said network the threads of the second and third system in superimposed layers. According to the invention, said filiform elements are disposed in staggered relation to one another from one sheet to the other and the threads of the second system and the threads of the third system are respectively introduced in two crossed oblique directions in the passages defined obliquely across the network of filiform elements owing to the staggered arrangement of the latter. These threads are preferably introduced in helical layers by a chain stitch knitting of two distinct threads, the loops of each of the two chain stitches thus made respectively forming said threads of the second and third systems inserted in said crossed passages. Said threads, which are placed in superimposed layers, should be compacted as they are introduced into the network.

The aforementioned filiform elements may be taut threads (directly constituting the first system of threads). They may also be temporary rods which are replaced by threads after finishing the weaving. There may also be employed hollow temporary rods in which the threads have been previously introduced and which are removed after the weaving has finished so that only the threads enclosed therein remain.

The invention further provides a machine for carrying out the method defined hereinbefore (with the use of temporary rods). This machine comprises, in the known manner, a fixed frame supporting an assembly of rotary elements centred on a generally vertical axis, driven in rotation about said axis and ensuring the maintenance of the rods which embody the threads of the first system in an even network of coaxial sheets, the longitudinal maintenance of said rods and the rotation of said network about said axis, and the compacting of the layers of the woven threads in the network of rods, and a knitting device placed on said frame in a fixed position at the level at which the reinforcement is woven, said rotary elements being constituted by plates provided with perforations which are evenly disposed on circles centred on the axis and through which the rods extend, one of said perforated plates undergoing, in addition to its movement of rotation, a controlled and progressive downward movement in the course of the weaving of the reinforcement and supporting the reinforcement by permitting its descent along the rods. According to the invention, the perforations of said plates are in staggered relation in the aforementioned successive circles and the knitting device comprises two needles which have a slide and undergo a longitudinal to-and-fro movement which is proper thereto and are oriented obliquely relative to the axis of rotation, the direction of one thereof passing to the right of said axis and the direction of the other to the left of said axis, said needles being so arranged that, in the course of their to-and-fro movement, they enter and travel along the oblique passages defined by the network of rods, one of the needles in the passages of one of the series, the other needle in the passages of the other series, so that each seizes a respective thread and knits it into a chain stitch, the loops of said two chain stitches thus made in the course of the rotation of the network of rods respectively forming the threads of the second system and the threads of the third system.

In practice, the oblique passages may be slightly curved, the needles being then correspondingly curved and guided in their to-and-fro movement by correspondingly curved slideways.

The radius of curvature of the needles must be equal to the average radius of the repetition cycles of the perforations in the plates at the right-angle intersection point of the oblique passages.

In order to effect the compacting of the woven mass in the network of rods, the machine advantageously comprises, at the top of the network of rods, a perforated plate carried by a fixed support having a slightly inclined attitude, and the needles of the knitting device are disposed adjacent and slightly below the upper part of this perforated plate whereas, on the other side, its lower part bears against the helical layers formed in the network of rods by the chain stitches knitted by said needles and ensures the compacting in the course of production of the woven reinforcement. Further, there is preferably disposed under the network of rods a fixed plate (unperforated) provided with a vibrating bar which ensures the longitudinal maintenance of the rods at a constant mean height without these rods having to bear and rub constantly against said fixed plate.

BRIEF DESCRIPTION OF THE DRAWINGS

The following description, with reference to the accompanying drawings given by way of non-limiting examples, will explain how the present invention may be carried out.

DESCRIPTION OF THE PREFERRED EMBODIMENT

It will first of all be mentioned that, if the number of coaxial sheets of rods in the part being produced varies from one figure to the other, it is simply for reasons of convenience of illustration. In practice, the number of these sheets is chosen in each case in accordance with the dimensions of the part to be produced.

Figure 1:
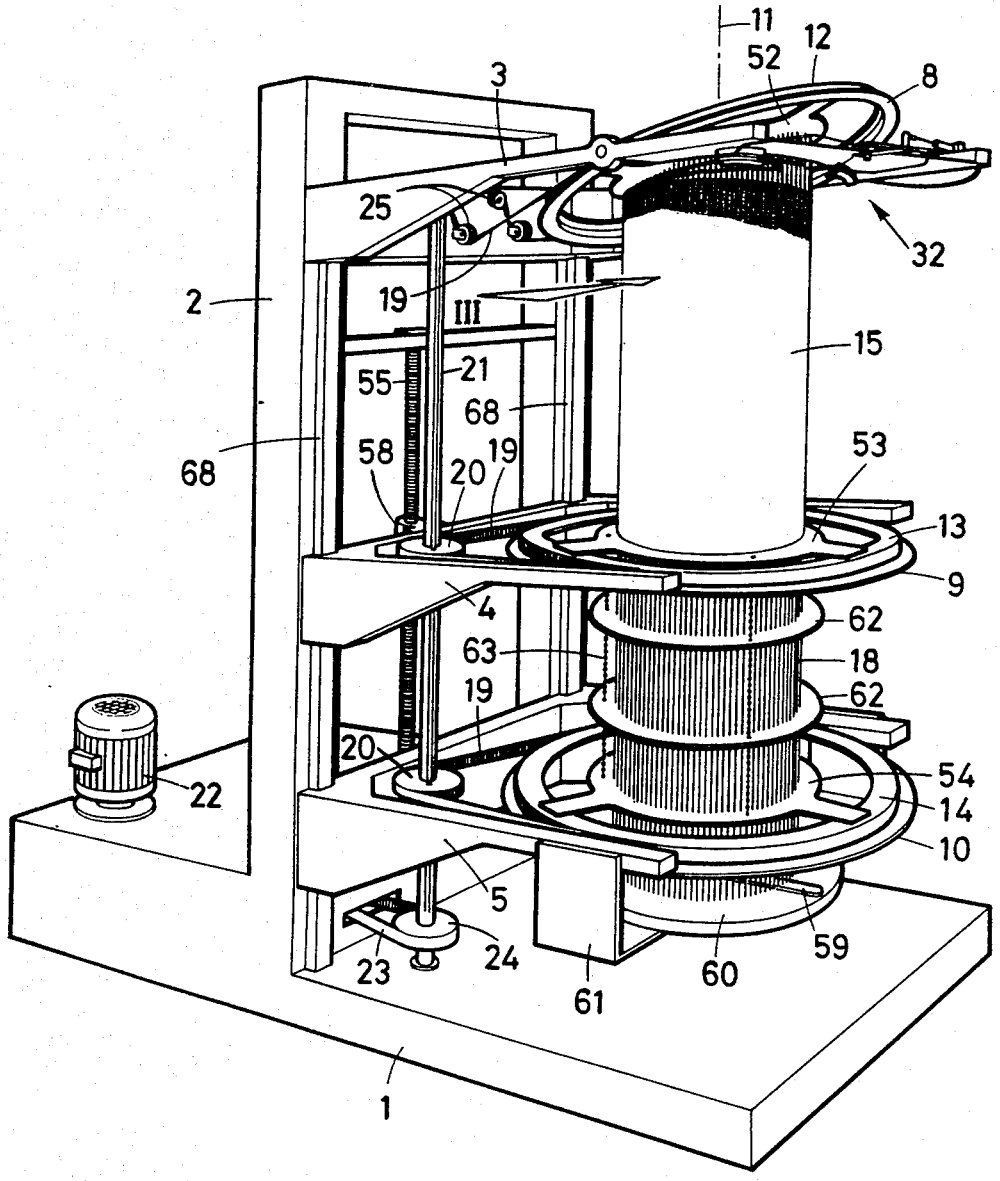
FIG. 1 is a perspective view of a three-dimensional weaving machine according to the invention.

The machine shown in FIG. 1 is adapted to produce, by a three-dimensional weaving, parts or reinforcements in the shape of a hollow cylinder of revolution with a structure imparting great deformability thereto.

This machine comprises mainly a stand 1 carrying a vertical frame 2 provided with three horizontal fork-shaped supports 3, 4, 5. The upper support 3 is fixed to the frame 2. The intermediate fork 4 is vertically movable and guided by a pair of vertical slides 68 fixed to the frame 2. It can be raised or lowered by the action of a vertical screwthreaded rod 55 which is driven in rotation and is engaged with a nut 58 mounted on said support. The lower support 5 maintains a fixed position during the operation of the machine but is adjustable (in accordance with the height of the part to be produced) by means of a suitable device (not shown) by sliding along said slides 68. Each of the supports 3, 4, 5 carries a circular frame. These frames 8, 9, 10 are in alignment along a vertical axis 11 which coincides with the axis of the reinforcements to be produced and each one thereof carries concentrically a rotary ring. Fixed to each of these rings 12, 13, 14 is a concentric annular plate which is contained in the same plane as the corresponding ring and frame. These plates 52, 53, 54 are perforated for receiving and maintaining in position a network of metal rods 18 parallel to the axis 11. They are driven in rotation about this axis by toothed belts 19 which respectively pass around the rings 12, 13, 14 and around drive pulleys 20 mounted on a vertical shaft 21 rotated by a motor 22 to which it is coupled by a transmission including at its output end a toothed belt 23 and a pulley 24. The intermediate support 4 and lower support 5 are vertically movable and the shaft 21 is splined and the corresponding pulleys 20 are slidable longitudinally along, while remaining drivenly engaged with, this shaft. Complementary perforated plates may be provided between the perforated plates 53 and 54, these plates 62 being suspended from chains 63. The upper frame 8 is, as shown, slightly inclined to the horizontal for a reason which will be explained hereinafter. This fact explains the presence of idler pulleys 25 around which the corresponding belt 19 must extend.

Figure 5:
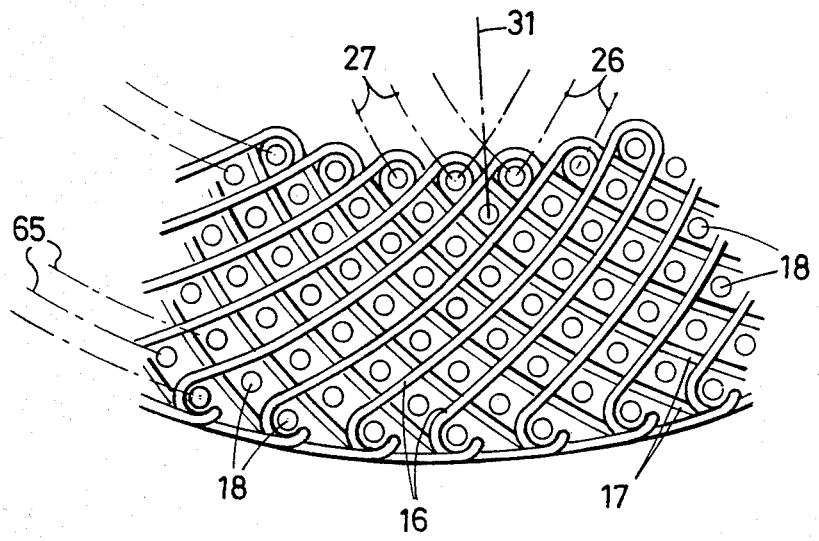
FIGS. 5 and 6 are respectively a cross-sectional view and a perspective view of a portion of the part being made up and showing the internal structure of this part.
Figure 6:
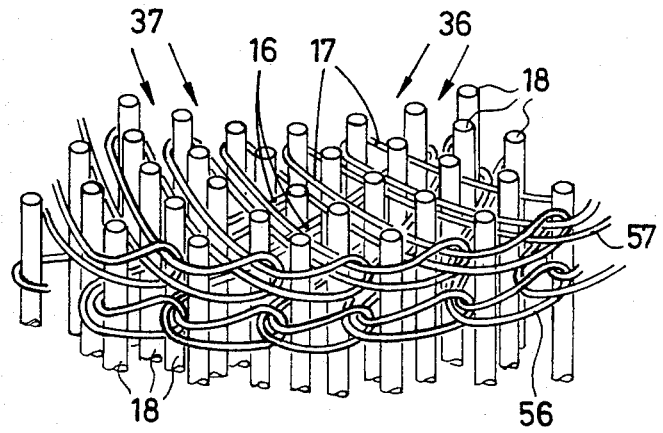

Each of the plates 52, 53, 54 is identically provided with perforations 30 (FIG. 2) evenly spaced apart on equidistant concentric circles, each circle having the same number of equidistant perforations. The perforations of a circle are in staggered relation to those of a neighbouring circle, i.e. the radii passing through the perforations of one circle dividing into two halves the gaps between the perforations of the other. By these perforations, the rods 18 are engaged in and extend through the plates 52, 53, 54 and are maintained therein in an even network comprising coaxial sheets 65 forming two series of oblique slightly curved rows 26, 27 of rods 18 (FIG. 5) extending in crossed directions symmetrical relative to the radial planes such as 31 passing through rods located at the intersection of rows of one and the other series. These oblique rows of rods define two series of passages or corridors 36, 37 (FIG. 6) which are oblique, i.e. nonradial, crossing substantially at a right angle and adapted to receive threads 46 (for one of the series) and 47 (for the other series) contained in planes perpendicular to the axis 11 and extending obliquely along said two substantially orthogonal directions throughout the thickness of the network of rods 18 (FIGS. 5 and 6).

The oblique threads 16, 17 are inserted in the network of rods 18 by a knitting of two chain stitches 56, 57 with threads 46, 47 emerging from two supply tubes 66, 67 by means of hooked needles 6, 7 (FIG. 2) which are each successively introduced into the oblique passages 36, 37 of one and the other of said series of passages. These hooked needles are part of a knitting device 32 (FIG. 1) mounted on the support 3. This device is shown in detain in FIG. 4 where however there is only shown, for reasons of clarity, a single needle, namely the needle 6, and the mechanism pertaining thereto, the other needle and its mechanism being symmetrically arranged relative to a radial plane. The needle 6, which is curved so as to be perfectly disposed in the passages 36 of the corresponding series, is moved with a longitudinal reciprocating movement and guided in a slide 33 which has the same curvature and is fixed to a member 34 pertaining to the support 3. This slide has a lateral slot 43 through which extends a lug 35 for driving the needle and connected by an articulated rod 38 to one of the arms of a T-shaped swing-bar 39 pivotable about a pivot 40, having a vertical axis and mounted on the member 34, under the action of a drive cable 41 actuated by the motor 22, the other arm of the swing-bar 39 receiving in a symmetrical manner a rod for actuating the other needle 7. The needles 6, 7 therefore alternately penetrate the oblique passages 36, 37 of the network of rods 18. The needle 6 (in the same way as the needle 7) is a needle having a slide which is constituted by the end portion of a rod 42 (FIG. 2) longitudinally slidable inside the needle for opening or closing the eye of the latter. This rod has a lug 44 which extends out of the body of the needle through a notch 51 and out of the slide 33 through the slot 43 and to which is articulated a rod 45 which slides in a member 48 mounted on a fixed element 49 and is braked by a friction strip 50.

Figure 2:
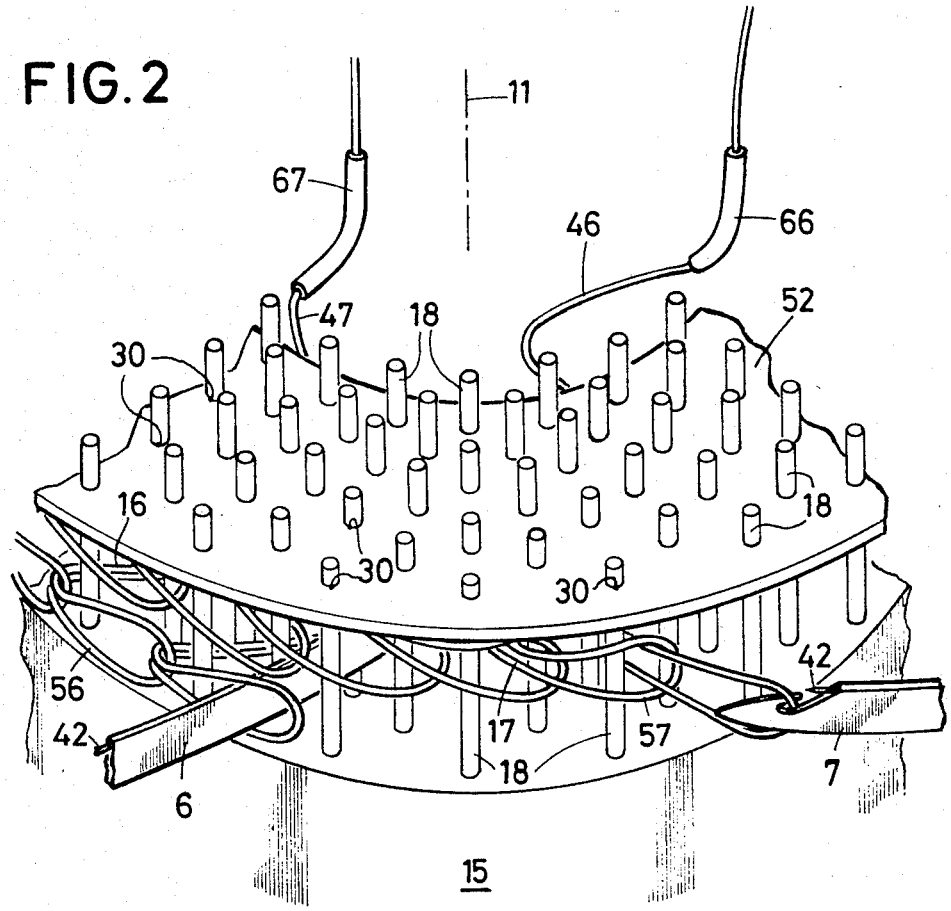
FIG. 2 is a simplified perspective view of the part of the machine corresponding to the weaving zone, as viewed from above.
Figure 4:
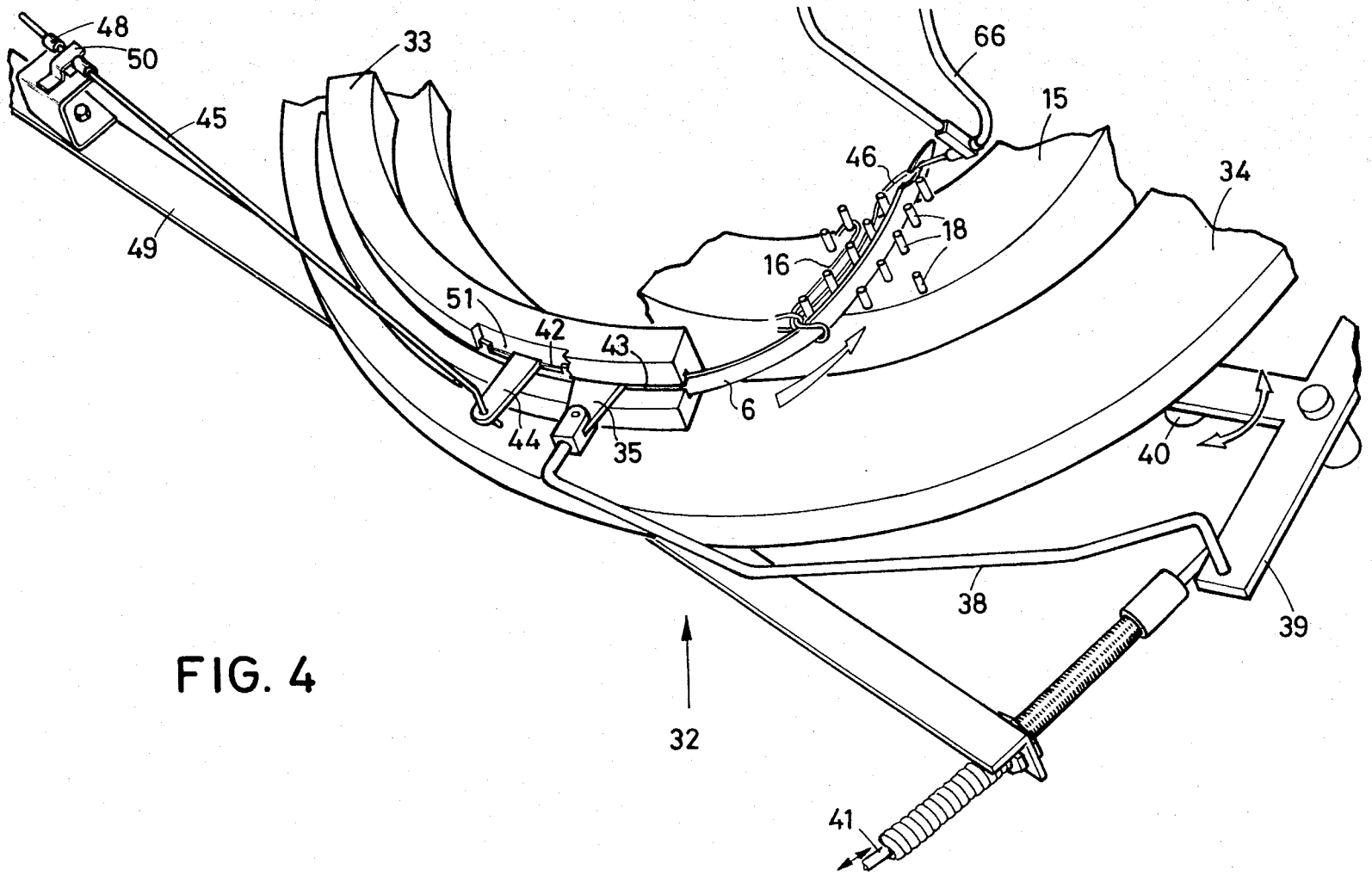
FIG. 4 is a perspective view of the mechanism actuating one of the needles of the knitting device of the machine.

The needle 6 having advanced, with the eye open, through the network of rods 18 to the end position shown in FIG. 4, it hooks the thread 46 and then moves rearwardly and pulls on a loop of this thread in the passage 36 in which it is disposed, to the other end position shown in FIG. 2 for the needle 7. In this rearward movement, the rod 42 first of all remains immobile (owing to the braking action of the strip 50) so that its end closes the eye, and then moves rearwardly with the needle, its lug 44 abutting against the forward edge of the notch 51. The needle stops outside the network of rods so as to form a thread loop. As its eye was opened by a reverse movement of the rod 42, the needle releases the thread and once again penetrates the network by passing through the loop it has just formed. The needle 7 effects the same operations, but at a height slightly higher than that of the needle 6 and in a different direction (FIG. 2).

Figure 3:
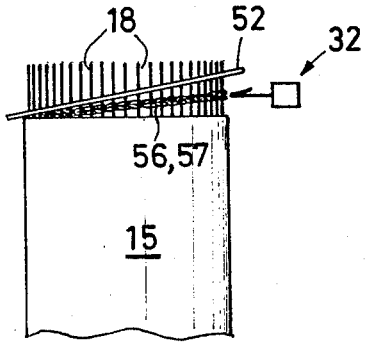
FIG. 3 is a partial diagrammatic view of a part in the course of being made up on the machine, as viewed in the direction of arrow III of FIG. 1.

In operation, the motor 22 of the machine continuously drives in rotation the network of rods 18. This network thus permanently passes in front of the fixed knitting device 32 and the needles 6, 7 of the latter insert in the network two chain stitches 56, 57 which are superimposed in helical layers. The loops are formed around the oblique rows 26, 27 of rods and constitute oblique threads 16, 17 which cross each other and cross with the rods 18. The threads 16, 17 thus form a second and a third system of threads crossing with a first system of rods 18 which will be thereafter replaced (according to the method described by the applicant in French patent application No. 80/17 666) by threads of the same kind as the threads of the second and third systems. As the woven mass 15 is formed in the network of rods 18, the perforated plate 53, which was initially close to the upper support 3, descends and supports this woven mass of increasing height, which is continuously compacted by the upper perforated plate 52 owing to the inclination given to the latter (at an angle depending on the diameter of the part to be produced and normally less than or equal to 15°). It can indeed be seen in FIG. 3 that the chain stitches 56, 57 formed by the knitting device 32 (placed adjacent to the upper part of the plate 52) are urged downwardly and compacted by the lower part of the plate 52. The continuous downward movement of the plate 53 drives downwardly the woven mass 15 and the rods 18, which are periodically raised upon their passage over a vibrating bar 59 carried by a circular plate 60 connected to the lower support 5 by a member 61. The rods 18 thus maintain a mean position which is invariable in height.

Figure 7:
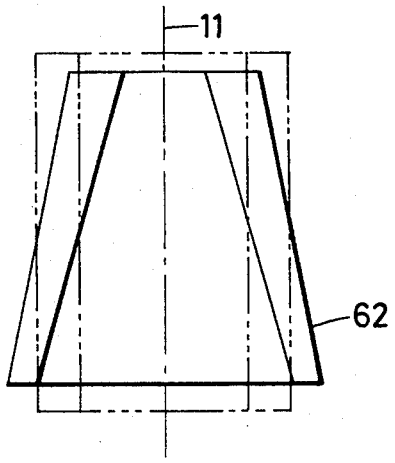
FIGS. 7 to 9 represent three examples of parts of complex shape obtained by deformation of the cylindrical parts produced in accordance with the invention.
Figure 8:
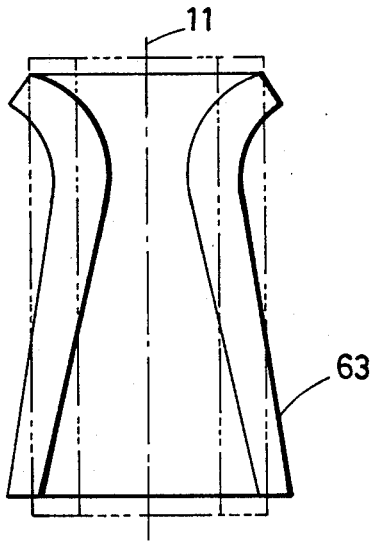
Figure 9:
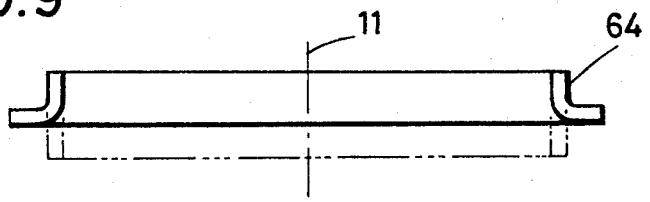

FIGS. 7 to 9 illustrate the capacity that the woven reinforcements produced have to deform, by squeezing or stretching some of their parts in accordance with the desired shape. The deformations are produced by modifications in the angle of the crossing of the threads 16 and 17. FIG. 7 shows a conical reinforcement 62 obtained by expanding one side and contracting the other side of a cylindrical reinforcement shown in dot-dash lines. FIG. 8 shows a reinforcement 63 for a nozzle having a convergent part, a neck and a divergent part. FIG. 9 shows a woven part 64 to which a flanged washer shape has been imparted. When the desired shape has been obtained, the part is impregnated and then stoved so as finally to fix this shape.

Having now described my invention what I claim as new and desire to secure by Letters Patent is:

1. A reinforcement in the shape of a hollow cylindrical body of revolution about an axis, made by a three-dimensional weaving of three systems of threads comprising a first system of threads which are parallel to the axis of the reinforcement and disposed in an equidistant manner in coaxial sheets which sheets are also equidistant, said first system of threads defining therebetween two respective series of crossed passages, and a second system of threads and a third system of threads substantially contained in planes perpendicular to said axis, forming superimposed layers and inserted in said two respective series of crossed passages, the threads of said first system being disposed in staggered relation to each other from one sheet to the neighbouring sheet and the two sheets of crossed passages defined therebetween extending through the thickness of the reinforcement in an oblique non-radial direction.

2. A reinforcement according to claim 1, wherein said two series of passages have an obliqueness of the same value but of opposite direction relative to radial directions at intersections of said two series of passages.

3. A reinforcement according to claim 1, wherein the threads of said second system and said third system are formed by loops of two chain stitches respectively formed in helical coils in the network of said first system.

4. A reinforcement according to claim 2, wherein the threads of said second system and said third system are formed by loops of two chain stitches respectively formed in helical coils in the network of the threads of said first system.

5. A method of producing a woven reinforcement in the shape of a hollow cylindrical body of revolution about an axis, made by a three-dimensional weaving of three systems of threads, namely a first system of threads which are parallel to the axis of the reinforcements and disposed in an equidistant manner in coaxial sheets which sheets are also equidistant, said first system of threads defining therebetween two respective series of crossed passages, and a second system of threads and a third system of threads substantially contained in planes perpendicular to said axis, forming superimposed layers and inserted in said two respective series of crossed passages, said method comprising: forming around said axis an arranged network of filiform elements which are parallel to said axis to form the threads of the first system, said first system threads being dispsoed evenly in successive coaxial sheets and defining therebetween two respective series of crossed passages; and introducing in said two series of crossed passages the threads of said second and said third system in superimposed layers; said filiform elements being disposed in staggered relation to each other from one sheet to the neighboring sheet and the threads of said second system and the threads of said third system being respectively introduced in two crossed oblique directions in said passages defined through the network of filiform elements owing to the staggered disposition of said filiform elements.

6. A method according to claim 5, wherein the threads of said second system and the threads of said third system are introduced in helical layers by knitting a chain stitch from two distinct threads, loops of each of the two chain stitches thus produced respectively forming said threads of said second system and said threads of said third system inserted in said crossed passages.

7. A method according to claim 5, wherein the threads are compacted as they are introduced into the network.

8. A method according to claim 6, wherein the threads are compacted as they are introduced into the network.

9. A method according to claim 5, wherein the filiform elements are taut threads.

10. A method according to claim 6, wherein the filiform elements are taut threads.

11. A method according to claim 5, wherein the filiform elements are rods which are replaced by threads after termination of the weaving.

12. A method according to claim 6, wherein the filiform elements are rods which are replaced by threads after termination of the weaving.

13. A method according to claim 5, wherein the filiform elements are hollow rods in which threads were previously inserted and which are eliminated after termination of the weaving.

14. A method according to claim 6, wherein the filiform elements are hollow rods in which threads were previously inserted and which are eliminated after termination of the weaving.

15. A machine for producing a reinforcement in the shape of a hollow cylindrical body of revolution about an axis, made by a three-dimensional weaving of three systems of threads namely a first system of threads which are parallel to the axis of the reinforcement and disposed in an equidistant manner in coaxial sheets which sheets are also equidistant, said first system of threads defining therebetween two respective series of crossed passages, and a second system of threads and a third system of threads substantially combined in planes perpendicular to said axis, forming superimposed layers and inserted in said two respective series of crossed passages, said machine comprising; a fixed frame: an assembly of rotary elements centred on a general vertical axis and supported by the frame: means for driving the rotary elements in rotation about said axis: rods which embody the threads of said first system supported by said rotary elements in an even network of coaxial sheets, the rotary elements longitudinally maintaining the rods in position and rotating said network about said axis and compacting layers of woven threads in the network of rods: a knitting device placed on said frame in a fixed position at a level where the reinforcement is woven: said rotary elements being constituted by plates having perforations which are disposed evenly on successive circles centred on said axis and through which perforations the rods extend: means for imparting to one of said perforated plates, a controlled and progressive downward movement in addition to the movement of rotation of said one plate in the course of the weaving of the reinforcement so as to support the reinforcement while allowing the reinforcement to descend along the rods: the perforations of said plates being disposed in staggered relation to each other in said successive circles and the knitting device including two needles each having a slide: means for imparting to the needles a respective longitudinal to-and-fro movement in a path oriented obliquely relative to said axis of rotation, the path of one of the needles having a direction passing to the right of said axis and the path of the other needle having a direction passing to the left of said axis: said needles being so arranged that, upon their to-and-fro movement, they penetrate and travel in oblique passages defined by the network of rods, one needle travelling in the passages of one of the series and the other needle travelling in the passages of the other series, each needle being capable of seizing a respective thread and knitting the respective thread in a chain stitch, loops of the two chain stitches thus produced in the course of the rotation of the network of rods respectively forming the threads of said second system and the threads of said third system.

16. A machine according to claim 15, wherein the oblique passages are slightly curved and the needles are correspondingly curved and correspondingly curved slides guide the needles in their to-and-fro movement.

17. A machine according to claim 15, comprising, at the top of the network of rods, a perforated plate carried by a support which is fixed in a slightly inclined position, the needles of the knitting device being disposed adjacent to and slightly below an upper part of said perforated plate, whereas, on an opposed side of said perforated plate, the lower part thereof bears against helical layers formed in the network of rods by the chain stitches knitted by the needles and ensures a compacting of said helical layers.

18. A machine according to claim 16, comprising, at the top of the network of rods, a perforated plate carried by a support which is fixed in a slightly inclined position, the needles of the knitting device being disposed adjacent to and slightly below an upper part of said perforated plate whereas, on an opposite side of said perforated plate, the lower part thereof bears against helical layers formed in the network of rods by the chain stitches knitted by the needles and ensures a compacting of said helical layers.

19. A machine according to claim 15, comprising, disposed under the network of rods, a fixed plate associated with a vibrating bar which longitudinally maintains the rods at a constant mean height.

20. A machine according to claim 16, comprising, disposed under the network of rods, a fixed plate associated with a vibrating bar which longitudinally maintains the rods at a constant mean height.

* * * * *